US010012242B2

(12) United States Patent
Yamagata et al.

(10) Patent No.: US 10,012,242 B2
(45) Date of Patent: Jul. 3, 2018

(54) AXIAL FLOW FAN

(71) Applicant: Nidec Corporation, Kyoto (JP)

(72) Inventors: Ryota Yamagata, Kyoto (JP); Tsukasa Takaoka, Kyoto (JP); Ryota Hayashida, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 160 days.

(21) Appl. No.: 14/872,492

(22) Filed: Oct. 1, 2015

(65) Prior Publication Data

US 2016/0097402 A1 Apr. 7, 2016

Related U.S. Application Data

(60) Provisional application No. 62/060,711, filed on Oct. 7, 2014.

(51) Int. Cl.

| | |
|---|---|
| ***F04D 19/00*** | (2006.01) |
| ***F04D 29/70*** | (2006.01) |
| ***F04D 29/54*** | (2006.01) |
| ***F04D 25/06*** | (2006.01) |

(52) U.S. Cl.

CPC ..... *F04D 29/703* (2013.01); *F04D 19/002* (2013.01); *F04D 25/068* (2013.01); *F04D 25/0613* (2013.01); *F04D 29/54* (2013.01)

(58) Field of Classification Search

CPC ..... F04D 29/54; F04D 29/703; F04D 19/002
See application file for complete search history.

(56) References Cited

U.S. PATENT DOCUMENTS 4,425,840 A * 1/1984 Masao ..... F04D 25/10 454/285
6,692,240 B1 * 2/2004 Leonhard ..... F04B 39/066 310/62
2005/0220637 A1 * 10/2005 Kobel ..... F04B 39/066 417/372

(Continued)

FOREIGN PATENT DOCUMENTS

CN 102478027 A 5/2012
DE 10 2012 109 516 A1 4/2014

(Continued)

OTHER PUBLICATIONS

Yamagata et al., "Axial Flow Fan", U.S. Appl. No. 15/901,967, filed Feb. 22, 2018.

*Primary Examiner* — Patrick Hamo
(74) *Attorney, Agent, or Firm* — Keating & Bennett, LLP

(57) ABSTRACT

A fan includes a motor part, an impeller fixed to the motor part, and a housing including a cylindrical inner circumferential surface. The impeller includes a plurality of blades extending radially outward. The housing is arranged to surround outer peripheries of the motor part and the impeller. The housing includes an intake port which is an upper opening of the housing, an upper edge which surrounds the intake port, an exhaust port which is a lower opening of the housing, a lower edge which surrounds the exhaust port. An axial distance from an upper end of each of the blades to an upper edge is ½ times or more of an axial distance from the upper end of each of the blades to a lower end thereof. This makes it possible to restrain an air flow having a swirling component from passing through the intake port.

16 Claims, 11 Drawing Sheets

(56) References Cited

U.S. PATENT DOCUMENTS

| | | | | |
|---|---|---|---|---|
| 2007/0297913 | A1* | 12/2007 | Reuter | F04D 29/601<br>416/93 R |
| 2008/0045133 | A1* | 2/2008 | Pfannenberg | B01D 46/10<br>454/184 |
| 2012/0163973 | A1 | 6/2012 | Yu | |
| 2014/0209275 | A1* | 7/2014 | Schone | F04D 29/541<br>165/96 |
| 2015/0147160 | A1* | 5/2015 | Crawford | F04D 29/545<br>415/121.2 |
| 2015/0147161 | A1* | 5/2015 | Crawford | F04D 29/545<br>415/121.2 |
| 2015/0252818 | A1 | 9/2015 | Heli et al. | |

FOREIGN PATENT DOCUMENTS

| | | | | | |
|---|---|---|---|---|---|
| GB | 2 168 756 | A | | 6/1986 | |
| JP | 03-168399 | A | | 7/1991 | |
| JP | 2008-175099 | A | | 7/2008 | |
| JP | 2016133038 | A | * | 7/2016 | F04D 29/54 |
| JP | WO 2016116996 | A1 | * | 7/2016 | F04D 29/54 |
| TW | 201226707 | A1 | | 7/2012 | |

* cited by examiner

AXIAL FLOW FAN

BACKGROUND OF THE INVENTION

1. Field of the Invention

The present invention relates to an axial flow fan.

2. Description of the Related Art

In recent years, the quietness of a fan is increasingly required. Japanese Patent Application Publication No. 3-168399 discloses a structure of a fan in which noises are reduced by disposing a flow straightening body 10 at the intake side of a cooling fan 4. However, in the structure of Japanese Patent Application Publication No. H3-168399, the flow straightening body 10 is not sufficiently spaced apart from the cooling fan 4. Thus, there is a possibility that the flow straightening body 10 is deformed by the wind pressure of an air drawn into the cooling fan 4.

SUMMARY OF THE INVENTION

In one exemplary preferred embodiment of the present invention, a fan includes a motor part arranged to rotate about a center axis extending up and down, an impeller, a housing and a plurality of ribs. The impeller includes a plurality of blades extending radially outward. The impeller is fixed to the motor part. The housing is arranged to surround outer peripheries of the motor part and the impeller. The housing includes a cylindrical inner circumferential surface. The ribs are arranged to interconnect the motor part and the housing. The housing includes an intake port which is an upper opening of the housing, an upper edge which surrounds the intake port, an exhaust port which is a lower opening of the housing, a lower edge which surrounds the exhaust port, and a flow straightening grid disposed in the upper edge. An axial distance from an upper end of each of the blades to a lower end of the flow straightening grid is ½ times or more of an axial distance from the upper end of each of the blades to a lower end thereof.

According to one exemplary preferred embodiment of the present invention, it is possible to make the fan quiet.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Exemplary preferred embodiments of the present invention will now be described with reference to the accompanying drawings. In the following descriptions, the direction parallel to or substantially parallel to the center axis of the fan will be referred to as an "axial direction". The direction orthogonal to or substantially orthogonal to the center axis of the fan will be referred to as a "radial direction". The direction extending along an arc centered at the center axis of the fan will be referred to as a "circumferential direction".

Figure 1:
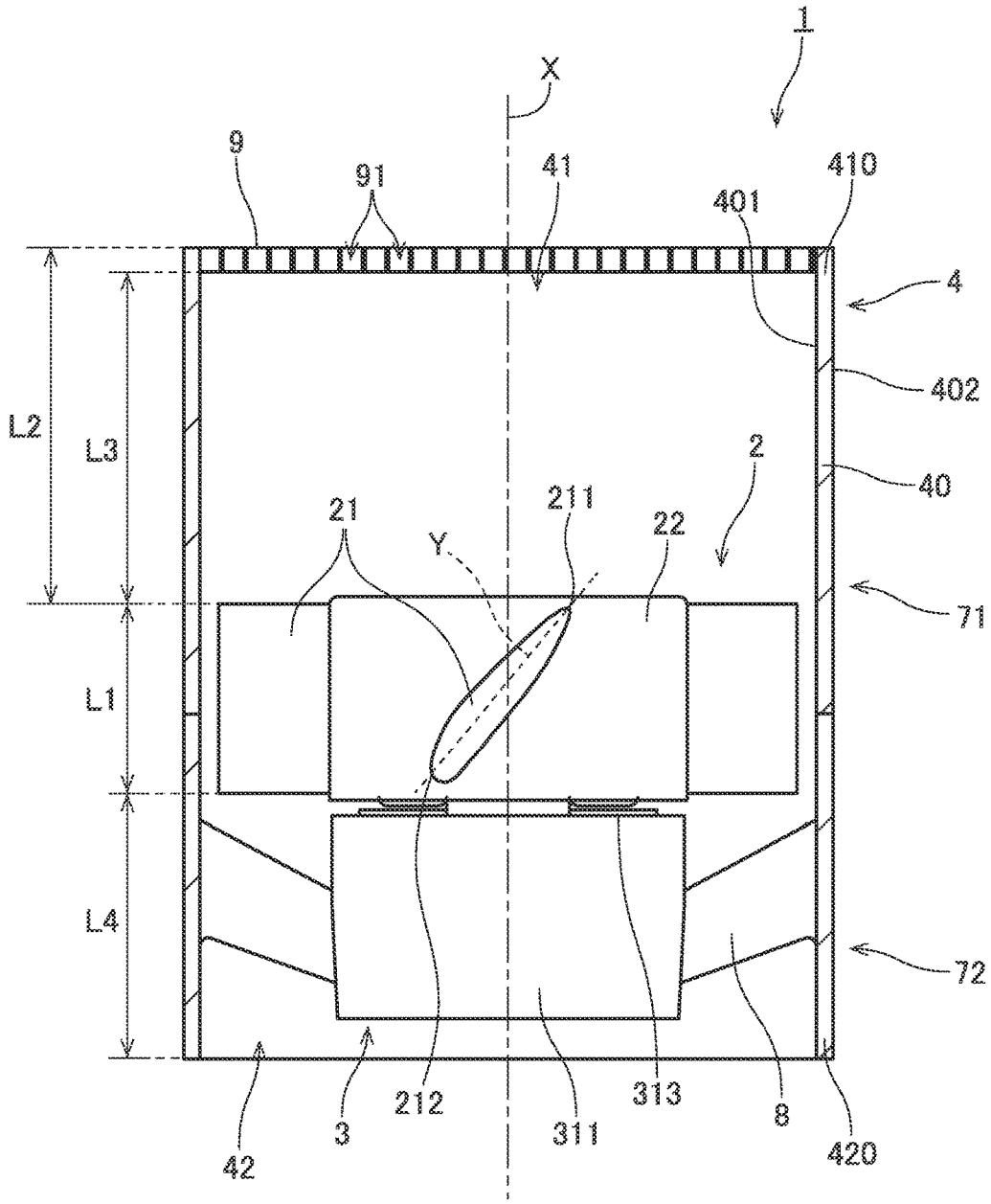
FIG. 1 is a vertical sectional view of a housing part and a flow straitening grid of a fan according to one preferred embodiment at line A-A as seen in FIG. 3.
Figure 2:
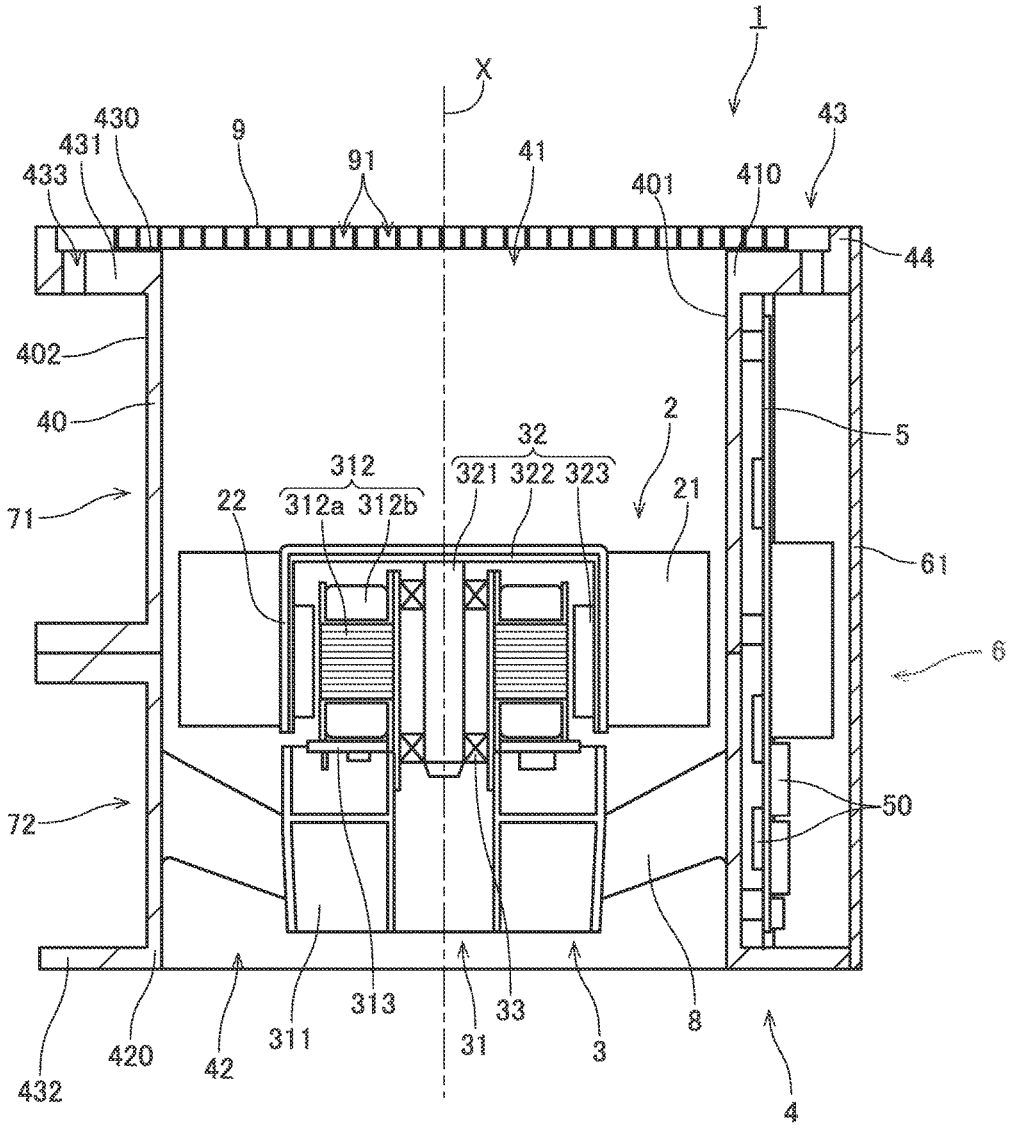
FIG. 2 is a vertical sectional view of the fan according to one preferred embodiment at line B-B as seen in FIG. 3.

FIGS. 1 and 2 are vertical sectional view of a fan 1 according to one preferred embodiment of the present invention. FIG. 1 illustrates a cross section taken along line A-A in FIG. 3. In FIG. 1, an impeller 2 and a motor part 3 are illustrated without breaking them. FIG. 2 illustrates a cross section taken along line B-B in FIG. 3.

In the fan 1, by virtue of rotation of the impeller 2, an air is drawn from the upper side in FIG. 1 (namely, the upper side of the fan 1) and is discharged toward the lower side (namely, the lower side of the fan 1), whereby a flow of air moving in a center axis X direction is generated. In the following descriptions, in the center axis X direction, the upper side in FIG. 1 at which an air is drawn will be referred to as an "intake side" or simply as an "upper side", and the lower side in FIG. 1 at which an air is discharged will be referred to as an "exhaust side" or simply as a "lower side". The expressions "upper side" and the "lower side" need not necessarily match with the upper side and the lower side in the gravity direction.

As illustrated in FIGS. 1 and 2, the fan 1 includes an impeller 2, a motor part 3, a housing 4, a first circuit board 5, a cover 6 and a plurality of ribs 8.

The impeller 2 is fixed to the motor part 3. The impeller 2 includes a cup portion 22 having a closed-top cylindrical shape and a plurality of blades 21 extending radially outward from an outer circumferential surface of the cup portion 22.

The motor part 3 includes a stationary unit 31 and a rotary unit 32. The stationary unit 31 is kept stationary relative to the housing 4. The rotary unit 32 is rotatably supported with respect to the stationary unit 31. The rotary unit 32 of the motor part 3 rotates the impeller 2 about a center axis X extending in an up-down direction.

The stationary unit 31 includes a cylindrical base portion 311, a stator 312 as an armature fixed to the base portion 311, and a second circuit board 313. The stator 312 includes a stator core 312*a* and a plurality of coils 312*b*. The coils 312*b* are electrically connected to the first circuit board 5 and the second circuit board 313. In the present preferred embodiment, the first circuit board 5 is connected to the coils 312*b* via the second circuit board 313. The second circuit board 313 is disposed under the stator 312 to extend in a direction orthogonal to the center axis X. A plurality of electronic components is mounted on the second circuit board 313.

The rotary unit 32 includes a shaft 321, a rotor hub 322 and a magnet 323. The shaft 321 is a columnar member disposed along the center axis X. The shaft 321 is supported on the stationary unit 31 through bearings 33 so as to rotate about the center axis X. The rotor hub 322 is a closed-top cylindrical member which rotates together with the shaft 321. The rotor hub 322 is disposed above the base portion 311. An inner circumferential surface of the cup portion 22 of the impeller 2 is fixed to an outer circumferential surface of the rotor hub 322. An annular magnet 323 is fixed to an inner circumferential surface of the rotor hub 322. The magnet 323 is radially opposed to an outer circumferential surface of the stator core 312*a*.

In the motor part 3 described above, if a drive current is supplied from an external power source to the coils 312*b* via the first circuit board 5 and the second circuit board 313, magnetic fluxes are generated in the stator core 312*a*. Then, a circumferential torque is generated by the action of magnetic fluxes between the stator core 312*a* and the magnet 323. As a result, the rotary unit 32 and the impeller 2 are rotated about the center axis X with respect to the stationary unit 31. Thus, an air flow moving from the upper side toward the lower side is generated within the housing 4.

As illustrated in FIGS. 1 and 2, the housing 4 includes a cylindrical body portion 40 which surrounds the outer peripheries of the impeller 2 and the motor part 3. The body portion 40 includes a cylindrical inner circumferential surface 401 and a cylindrical outer circumferential surface 402. An upper opening of the body portion 40 of the housing 4 is an intake port 41. A lower opening of the body portion 40 of the housing 4 is an exhaust port 42. The body portion 40 includes an annular upper edge portion 410 disposed at the upper end portion thereof and arranged to surround the intake port 41. Furthermore, the body portion 40 includes an annular lower edge portion 420 disposed at the lower end portion thereof and arranged to surround the exhaust port 42.

Figure 4:
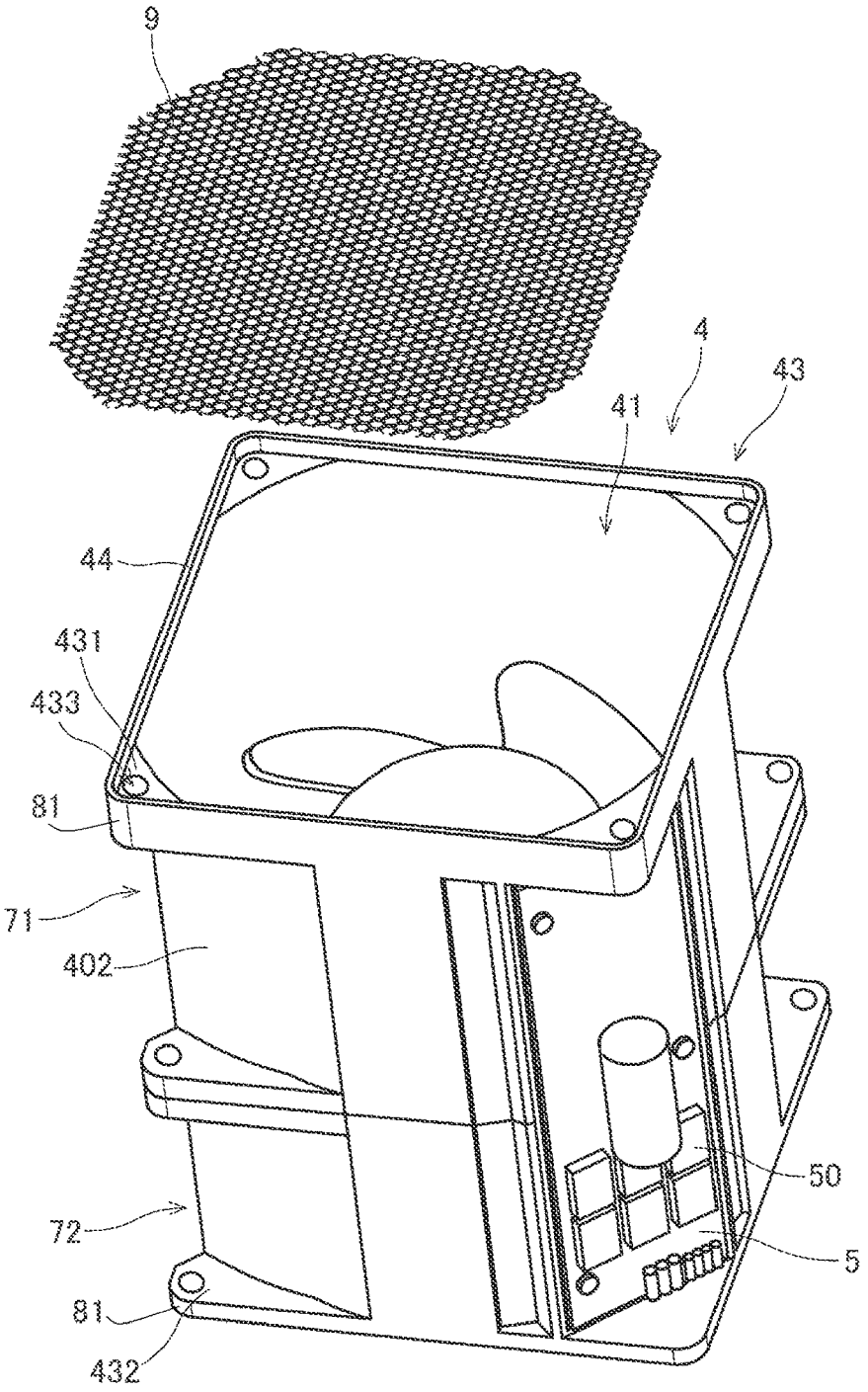
FIG. 4 is an exploded perspective view of the fan according to one preferred embodiment with a cover thereof removed.
Figure 5:
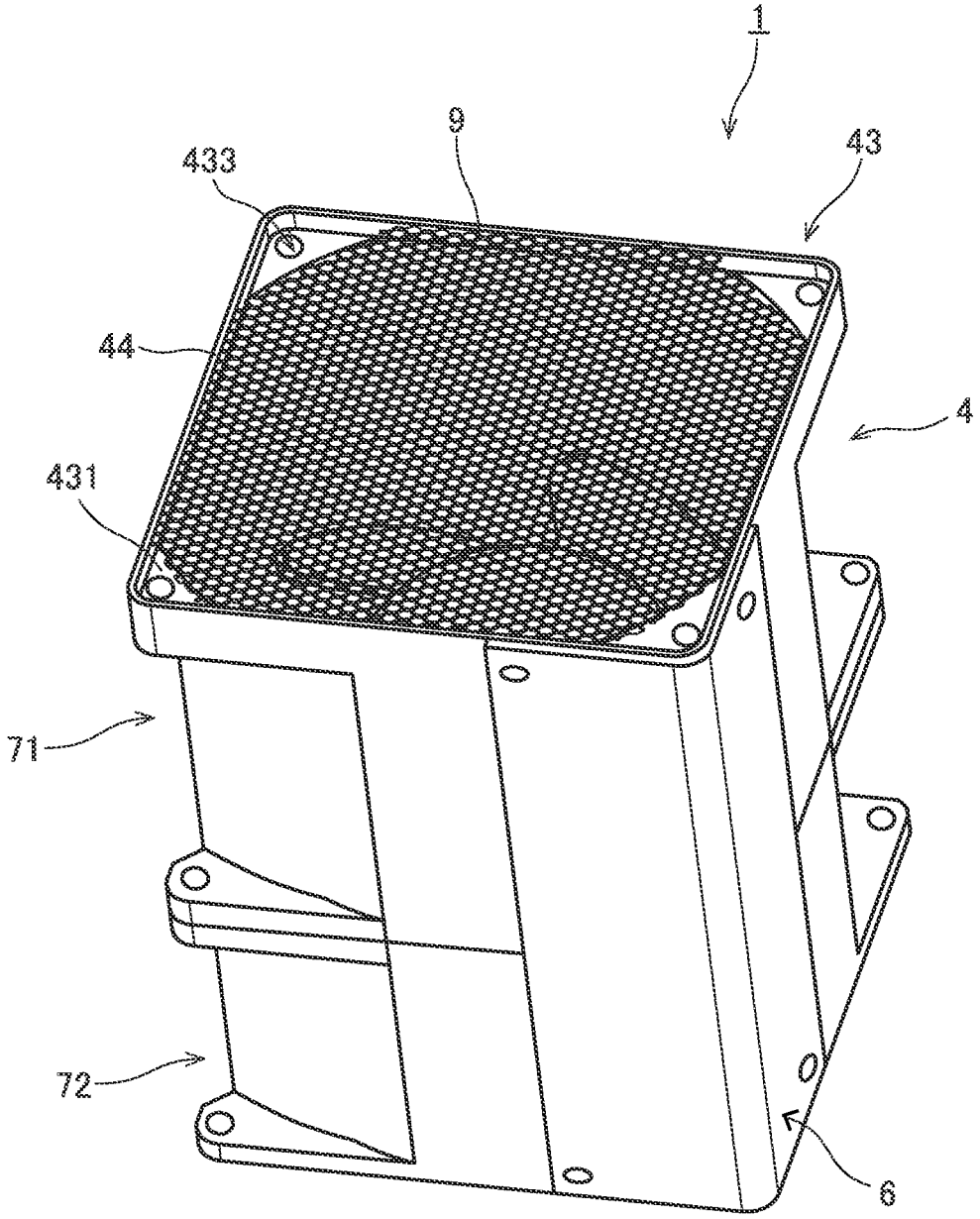
FIG. 5 is a perspective view of the fan according to one preferred embodiment.

FIG. 4 is an exploded perspective view of the fan 1 with the cover 6 removed. FIG. 5 is a perspective view of the fan 1. As illustrated in FIGS. 1, 2, 4 and 5, the housing 4 includes a first housing 71 positioned at an axial upper side and a second housing 72 disposed at an axial lower side of the first housing 71. Thus, the upper part of the body portion 40 is configured by the first housing 71, and the lower part of the body portion 40 is configured by the second housing 72.

Figure 3:
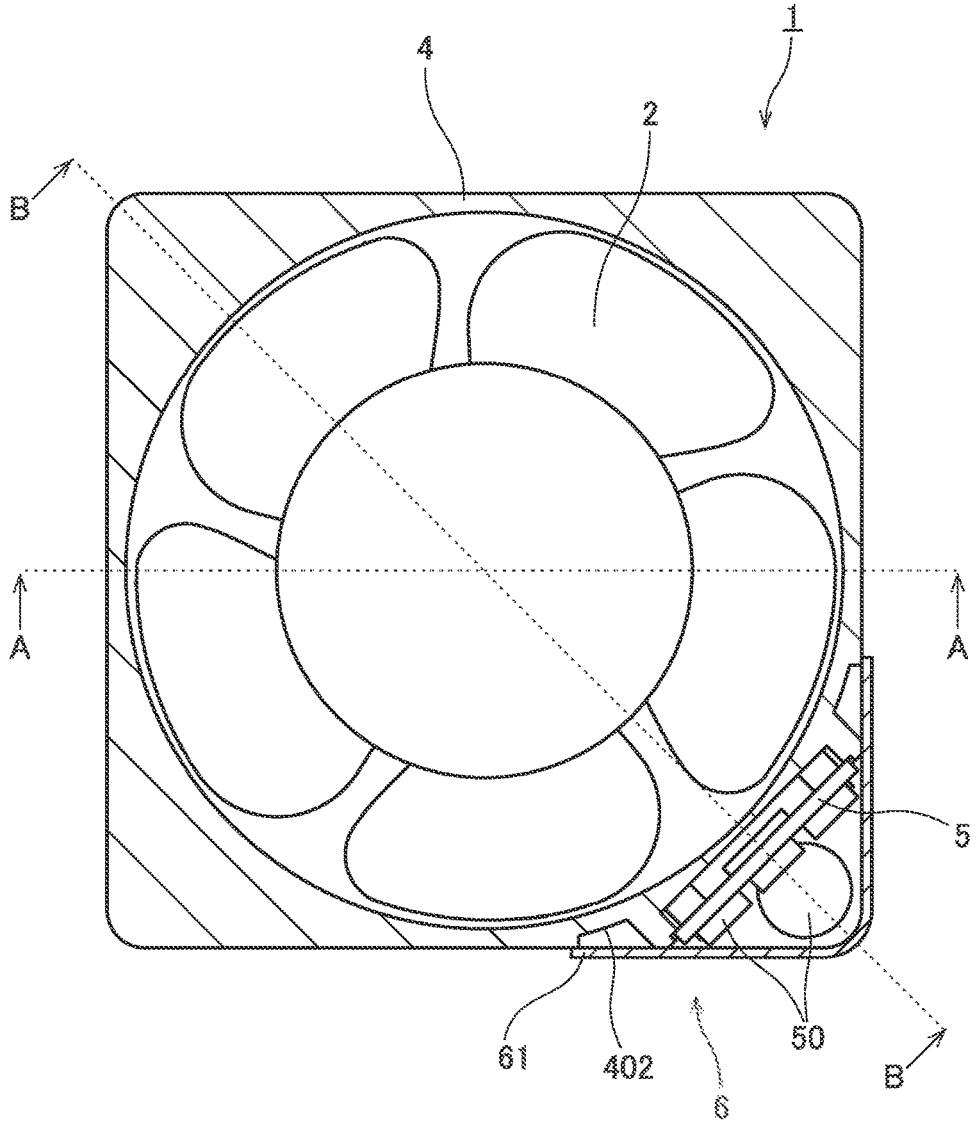
FIG. 3 is a horizontal sectional view of the fan according to one preferred embodiment.

As illustrated in FIGS. 2 and 3, the first circuit board 5 is positioned radially outward of the outer circumferential surface 402 of the housing 4. A plurality of electronic components 50 is mounted on the first circuit board 5. The first circuit board 5 is electrically connected to the coils 312*b* of the motor part 3 and the second circuit board 313.

The cover 6 includes an outer wall portion 61 disposed radially outward of the outer circumferential surface 402 of the housing 4. The cover 6 is a cover member formed independent of the housing 4.

The ribs 8 interconnect the motor part 3 and the housing 4. More specifically, the ribs 8 extend radially outward from the outer circumferential surface of the base portion 311 of the motor part 3 to the inner circumferential surface 401 of the housing 4. The ribs 8 are disposed below the impeller 2. The ribs 8 may be connected to the outer circumferential surface of the base portion 311 of the motor part 3 and the inner circumferential surface 401 of the housing 4 in an axially-shifted manner. Alternatively, the ribs 8 may be connected to the outer circumferential surface of the base portion 311 of the motor part 3 and the inner circumferential surface 401 of the housing 4 in a circumferentially-shifted manner (see FIG. 2).

Next, descriptions will be made on the noise generation during the operation of the fan 1 and the flow straightening grid 9.

As illustrated in FIG. 1, each of the blades 21 of the impeller 2 includes a leading edge 211 positioned at the front side in the rotation direction and a trailing edge 212 positioned at the back side in the rotation direction. It is preferred that when seen in a plan view, each of the blades 21 has a small blade interval. In order to reduce the blade interval, it is preferred that a virtual straight line Y interconnecting an arbitrary point of the leading edge 211 and an arbitrary point of the trailing edge 212 makes a large angle with respect to the center axis X. As the axial distance between the upper end of each of the blades and the lower end thereof becomes longer, the angle of the virtual straight line Y with respect to center axis X grows smaller.

During the rotation of the impeller 2, a swirling component is generated in the air drawn into between the blades 21. That is to say, during the rotation of the impeller 2, an air flow parallel to the axial direction does not move toward the blades 21 but an air flow having an angle with respect to the center axis X moves into between the blades 21. In this case, as the axial distance from the upper end of each of the blades 21 to the lower end thereof becomes longer, the swirling component of the air flow grows larger. As a guide, the swirling component of the air flow is mainly generated in a region extending upward from the upper end of each of the blades 21. Specifically, the region extending upward from the upper end of each of the blades 21 is ½ times of the axial distance from the upper end of each of the blades 21 and the lower end thereof.

As illustrated in FIG. 1, in the fan 1, the axial distance L2 from the upper end of each of the blades 21 of the impeller 2 to the upper end of the intake port 41 is ½ times or more of the axial distance L1 from the upper end of each of the blades 21 to the lower end thereof. Thus, the intake port 41 is disposed at the upper side of the region where the swirling component is mainly generated. That is to say, an air flow having a swirling component is restrained from passing through the intake port 41 of the housing 4. This makes it possible to reduce a noise level. Thus, it is possible to reduce noises generated during the operation of the fan 1, thereby making the fan 1 quiet.

As illustrated in FIG. 1, the housing 4 includes a flow straightening grid 9 disposed in the upper edge 410. Thus, the air flow moving through the intake port 41 passes through the flow straightening grid 9. The axial distance L3 from the upper end of each of the blades 21 to the end portion (lower end) of the flow straightening grid 9 existing at the side of the impeller 2 is ½ times or more of the axial distance L1 from the upper end of each of the blades 21 to the lower end thereof. By doing so, an air flow moves from the intake port 41 into the housing 4 with a swirling component kept low. Thus, the air flow is restrained from colliding with the flow straightening grid 9. In the fan 1, a windage loss caused by the flow straightening grid 9 is reduced. It is therefore possible to realize high air volume characteristics. In the fan 1, the air flow is restrained from colliding with the flow straightening grid 9. It is therefore possible to further reduce the noise value.

The axial distance L3 from the upper end of each of the blades 21 to the end portion of the flow straightening grid 9 existing at the side of the impeller 2 may be regarded as being approximate to the axial distance from the upper end of each of the blades 21 to the upper edge 410. Thus, the axial distance from the upper end of each of the blades 21 to the upper edge 410 will be hereinafter referred to as axial distance L3.

In the fan 1 of the present preferred embodiment, the axial distance L3 from the upper end of each of the blades 21 to the upper edge 410 is equal to or larger than the axial distance L1 from the upper end of each of the blades 21 to the lower end thereof. Furthermore, in the fan 1, the axial distance L2 from the upper end of each of the blades 21 to the intake port 41 is equal to or larger than the axial distance L4 from the lower end of each of the blades 21 to the exhaust port 42. That is to say, in the fan 1, the axial distance L3 between the impeller 2 and the upper edge 410 is set to become long. This makes it possible to increase the axial gap between the region where the swirling component is mainly generated and the upper edge 410. Accordingly, in the present preferred embodiment, it is possible to further reduce the noises generated during the operation of the fan 1, thereby making the fan 1 even quiet.

As mentioned above, as the axial distance L3 from the upper end of each of the blades 21 to the upper edge 410 becomes longer, the swirling component of the air flow passing through the flow straightening grid 9 grows smaller. This makes it possible to reduce the noises. On the other hand, if the axial distance L2 between the intake port 41 and the impeller 2 is too long, there is a possibility that the blowing efficiency decreases. Thus, as is the case in the fan 1 of the present preferred embodiment, it is preferred that the axial distance L3 from the upper end of each of the blades 21 to the upper edge 410 is set to become three times or less of the axial distance L1 from the upper end of each of the blades 21 to the lower end thereof.

As illustrated in FIGS. 1 and 2, the flow straightening grid 9 has a plurality of through-holes 91 extending parallel to the axial direction. It is an inevitable event that by the rotation of the impeller 2, a swirling component is generated in the air flow moving into between the blades 21. The swirling component of the air flow varies depending on the shape of the blades 21, the axial height of the blades 21 and the rotation speed of the blades 21. That is to say, it is difficult to control the swirling component. Accordingly, if the through-holes 91 extending parallel to the axial direction are formed in the flow straightening grid 9 and if the axial distance L3 from the end portion of the flow straightening grid 9 existing at the side of the impeller 2 to the upper end of each of the blades 21 is increased, it is possible to reduce the windage loss of the air passing through the through-holes 91 of the flow straightening grid 9.

As will be described later, the windage loss becomes smaller as the grid thickness in the direction perpendicular to the axial direction grows smaller. For that reason, it is preferable to use a flow straightening grid having a small grid thickness. However, the flow straightening grid having a small grid thickness is low in strength and is therefore easily deformed by the wind pressure or the swirling component of the air flowing into the intake port. As in the present preferred embodiment, if the axial distance L3 from the upper end of each of the blades 21 to the end portion (lower end) of the flow straightening grid 9 existing at the side of the impeller 2 is set to becomes ½ times or more of the axial distance L1 from the upper end of each of the blades 21 to the lower end thereof, the flow straightening grid 9 is disposed at a position sufficiently spaced apart from the impeller. It is therefore possible to suppress deformation of the flow straightening grid 9.

Figure 6:
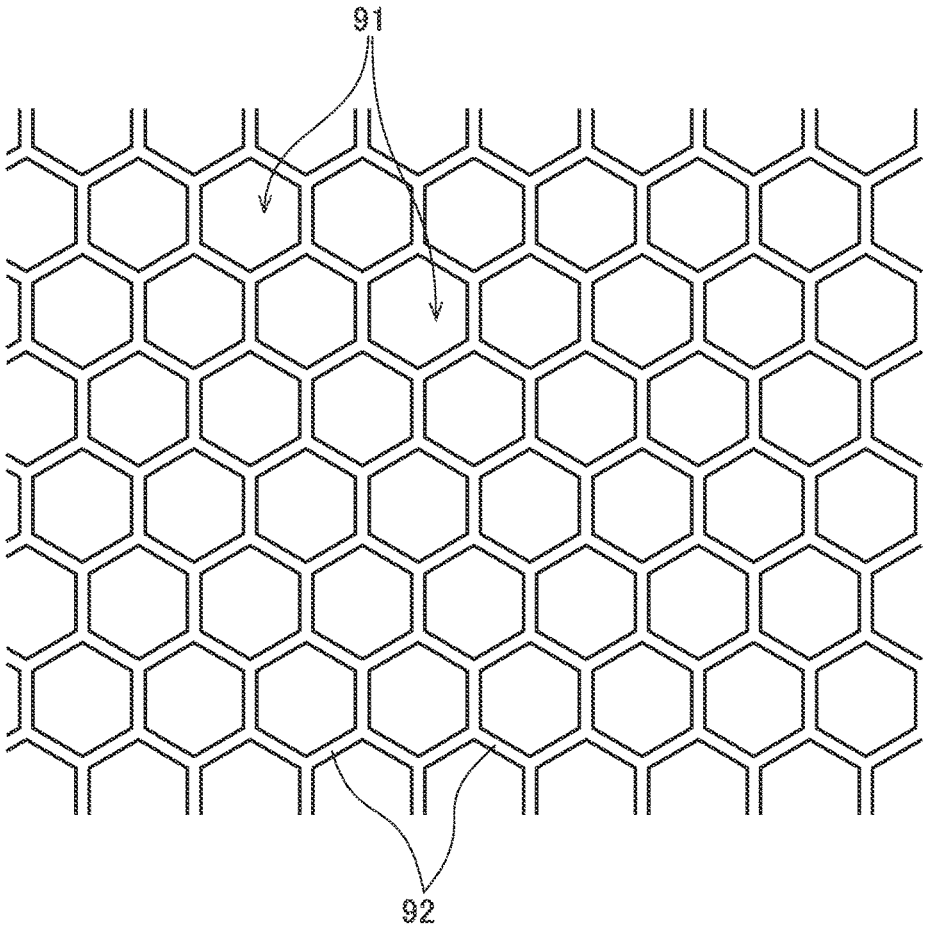
FIG. 6 is a partial top view of a flow straightening grid according to one preferred embodiment.

FIG. 6 is a partial top view of the flow straightening grid 9. As illustrated in FIG. 6, the flow straightening grid 9 is formed in a honeycomb shape by interconnecting plate-like side portions 92 extending along the axial direction. Each of the through-holes 91 is surrounded by six side portions 92 and has a hexagonal shape when viewed at one axial side.

Furthermore, it is preferred that the projection area of the flow straightening grid 9 projected from the direction perpendicular to the open direction of the intake port 41 (namely, the projection area of the flow straightening grid 9 on the plane perpendicular to the axial direction) is 10% or less of the projection area of the intake port 41 of the housing 4. That is to say, it is preferred that the total projection area of the side portions 92 projected from the axial direction is ⅙ or less of the total projection area of the through-holes 91. By employing this flow straightening grid 9, it is possible to increase the flow path area of the air passing through the flow straightening grid 9, while increasing the strength of the flow straightening grid 9. Accordingly, it is possible to suppress the reduction in the air volume caused by the flow straightening grid 9 to a minimum level.

Furthermore, it is preferred that the grid thickness of the flow straightening grid 9 in the direction perpendicular to the axial direction is 0.03 mm or more and 0.1 mm or less. The flow straightening grid 9 has an effect of forming a stable air flow by removing the inertial force of the air flow or the non-uniform flow velocity distribution. On the other hand, if the area occupied by the flow straightening grid 9 is increased when seen in a plan view, the air volume is reduced because the air flow impinges against the flow straightening grid 9. Accordingly, in the flow straightening grid 9, the effect as a flow straightening grid becomes higher as the grid thickness grows smaller.

In the present preferred embodiment, the axial gap between the intake port 41 and the impeller 2 is wide. Thus, the air flow passing through the intake port 41 is close to the flow parallel to the axial direction. For that reason, the swirling component is small. Accordingly, it is possible to make the thickness of the flow straightening grid as small as possible. However, the strength of the flow straightening grid 9 against the air flow becomes lower as the grid thickness grows smaller. That is to say, the thickness of the flow straightening grid 9 needs to be equal to or larger than a predetermined arbitrary thickness. Moreover, in order to maximize the effect of the flow straightening grid 9, there is a need to increase the number of the through-holes 91 as far as possible. On the other hand, as the number of the through-holes 91 becomes larger, the thickness of the flow straightening grid 9 needs to be made smaller. If not, the windage loss caused by the flow straightening grid 9 grows larger.

If the grid thickness is less than 0.03 mm, there is a possibility that the flow straightening grid 9 is deformed by the air flow. Furthermore, if the grid thickness is set to become less than 0.03 mm and if the area of the flow straightening grid 9 is set small so that the grid is not deformed, there is a possibility that the air volume is reduced. In the case where the grid thickness is larger than 0.1 mm, the windage loss of the air flow passing through the flow straightening grid 9 increases. However, if the number of the through-holes 91 constituting the flow straightening grid 9 is increased, the windage loss decreases. In this case, the function as the flow straightening grid 9 is deteriorated. Accordingly, it is preferred that the grid thickness of the flow straightening grid 9 is 0.03 mm or more and 0.1 mm or less.

Furthermore, it is preferred that the height of the flow straightening grid 9 in the direction parallel to the axial direction is 2.0 mm or more and 10 mm or less. When the air flow passes through the flow straightening grid 9, the air flow applies a considerable force to the flow straightening grid 9 in the direction perpendicular to the center axis X. In this case, if the axial dimension is small, the flow straightening grid 9 is easily deformed. If the axial dimension is large, a swirling flow is generated. In the case where the axial height of the flow straightening grid 9 is less than 2.0 mm, there is a possibility that the flow straightening grid 9 is deformed. In addition, if the axial height of the flow straightening grid 9 is larger than 10 mm, there is a possibility that a swirling flow is generated.

As illustrated in FIGS. 2 and 4, the housing 4 includes a flange portion 43 extending radially outward from the outer circumferential surface 402 of the housing 4. The flange portion 43 includes an upper flange portion 431 positioned in the upper portion of the housing 4 and a lower flange portion 432 positioned in the lower portion of the housing 4. The upper flange portion 431 extends radially outward from the upper edge 410. The lower flange portion 432 extends radially outward from the lower edge 420. The shape of radial outer edges of the upper flange portion 431 and the lower flange portion 432 is a substantially square shape. More specifically, the shape of radial outer edges of the upper flange portion 431 and the lower flange portion 432 is a substantially square shape having four corner portions 81. The four corner portions 81 are disposed at substantially regular intervals along the circumferential direction. In the present preferred embodiment, the radial outer ends of the corner portions 81 are chamfered in a curved surface shape.

The upper flange portion 431 includes grid mounting portions 430 formed on the upper surface thereof so that the flow straightening grid 9 is mounted on the grid mounting portions 430 at the radial outer side of the inner circumferential surface 401 of the housing 4. More specifically, the grid mounting portions 430 are formed on the upper surfaces of the corner portions 81 of the upper flange portion 431. By virtue of this configuration, the flow straightening grid 9 is fixed on its surface which faces the upper flange portion 431. It is therefore possible to fix the flow straightening grid 9 in a stable state. Since the flow straightening grid 9 is fixed at the radial outer side of the inner circumferential surface 401 of the housing 4, the fixing structure of the flow straightening grid 9 does not interfere with the flow path in the vicinity of the intake port 41. Accordingly, it is possible to widen the intake port 41 and to secure the air volume. In a case where the entire periphery of the flow straightening grid 9 is fixed, it is inevitable to provide the upper flange portion 431 over the entire periphery of the outer circumferential surface of the housing 4. Thus, the radial dimension of the housing 4 becomes larger. However, in the present preferred embodiment, the flow straightening grid 9 is fixed on its surface which faces the corner portions 81. This makes it possible to suppress the increase in the radial dimension of the housing 4 to a minimum level. In general, the structure in which the flow straightening grid 9 is fixed only on its surface facing the corner portions 81 is smaller in the holding area of the flow straightening grid 9 than the case where the entire periphery of the flow straightening grid 9 is fixed. Thus, the structure is readily affected by the external force such the wind pressure or the swirling component of the air flowing into the intake port. However, in the present preferred embodiment, the axial distance L3 from the upper end of each of the blades 21 to the end portion (lower end) of the flow straightening grid 9 existing at the side of the impeller 2 is set to become ½ times or more of the axial distance L1 from the upper end of each of the blades 21 to the lower end thereof. Thus, the flow straightening grid 9 is disposed in a position sufficiently spaced apart from the impeller. This makes it possible to suppress the influence on the flow straightening grid 9.

The upper flange portion 431 includes mounting holes 433 which are disposed radially outward of the grid mounting portions 430 and formed to axially penetrate the flange portion 43. By disposing the mounting holes 433 radially outward of the grid mounting portions 430, the mounting holes 433 are disposed radially outward of the flow straightening grid 9. Thus, when the fan 1 is mounted to actual equipment, there is no possibility that the flow straightening grid 9 is crushed and deformed by screws or the like.

As illustrated in FIGS. 2 and 4, the housing 4 includes a cylindrical wall portion 44 extending upward from the radial outer edge of the upper flange portion 431. The flow straightening grid 9 is disposed at the radial inner side of the wall portion 44. The axial position of the upper end of the wall portion 44 is flush with or higher than the axial position of the upper end of the flow straightening grid 9. This makes it possible to dispose the flow straightening grid 9 without causing the flow straightening grid 9 to protrude upward beyond the housing 4.

As illustrated in FIG. 5, the cover 6 has a shape which conforms to the radial outer edges of some portions of the upper flange portion 431 and the lower flange portion 432. Thus, as illustrated in FIG. 3, the first circuit board 5 is surrounded by the outer circumferential surface 402 of the housing 4 and the cover 6 when viewed from one axial side. Accordingly, dust does not adhere to the upper surface of the first circuit board 5.

Figure 7:
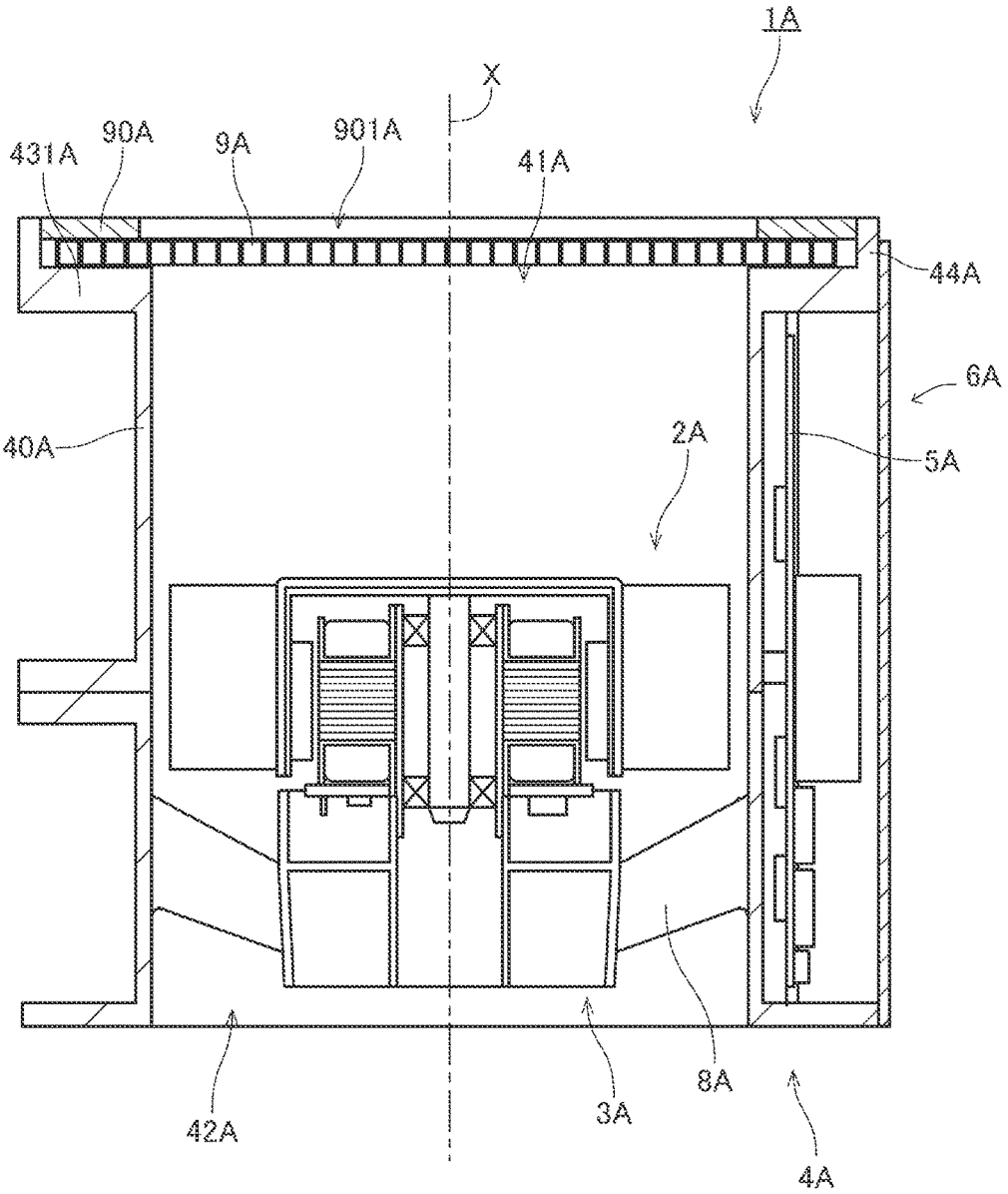
FIG. 7 is a vertical sectional view of a fan according to another preferred embodiment at line B-B as seen in FIG. 3.
Figure 8:
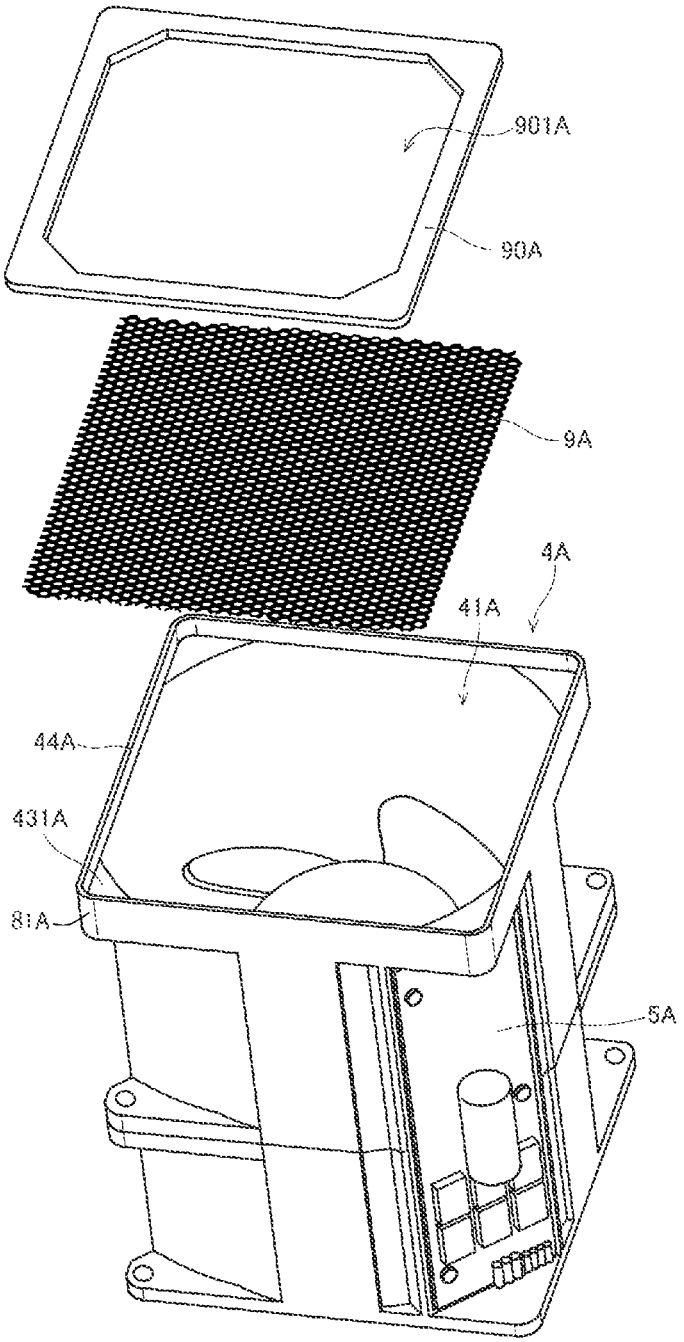
FIG. 8 is an exploded perspective view of the fan according to another preferred embodiment.

Next, a fan 1A according to another preferred embodiment will be described with reference to FIGS. 7 and 8. FIG. 7 is a vertical sectional view of the fan 1A. FIG. 8 is an exploded perspective view of the fan 1A with a cover 6A thereof removed. In FIG. 8, a flow straightening grid 9A and a holding member 90A are illustrated in a state in which they are separated from other members. Even in the fan 1A, similar to the fan 1 according to one preferred embodiment, the axial upper side in FIGS. 7 and 8 is an intake side and the axial lower side is an exhaust side.

As illustrated in FIG. 7, the fan 1A includes an impeller 2A, a motor part 3A, a housing 4A, a first circuit board 5A, a cover 6A, ribs 8A and a flow straightening grid 9A. The housing 4A includes a cylindrical body portion 40A which accommodates the impeller 2A and the motor part 3A, an upper flange portion 431A extending radially outward from the body portion 40A, and a cylindrical wall portion 44A extending upward from the radial outer edge of the upper flange portion 431A. The flow straightening grid 9A is disposed radially inward of the wall portion 44A.

As illustrated in FIGS. 7 and 8, an intake port 41A, which is an upper opening of the housing 4A, is provided at the upper end of the body portion 40A. An exhaust port 42A, which is a lower opening of the housing 4A, is provided at the lower end of the body portion 40A. The flow straightening grid 9A is placed on the upper surface of the upper flange portion 431A. More specifically, the flow straightening grid 9A is placed on the upper surfaces of the corner portions 81A of the upper flange portion 431A.

Moreover, the fan 1A further includes a holding member 90A. The outer edge of the holding member 90A has a substantially square shape. The holding member 90A has a central hole 901A which overlaps with the intake port 41A in the axial direction. Furthermore, the holding member 90A is disposed above the flow straightening grid 9A in a substantially perpendicular relationship with the center axis X to cover a portion of the upper surface of the flow straightening grid 9A. Specifically, the holding member 90A is disposed at the intake side of the intake port 41A of the housing 4A to cover the radial outer and axial upper surface of the flow straightening grid 9A.

The holding member 90A is fixed to the housing 4A by bonding, screw fixing or the like. Thus, the flow straightening grid 9A is held between the housing 4A and the holding member 90A. That is to say, the flow straightening grid 9A is prevented from being removed from the housing.

Figure 9:
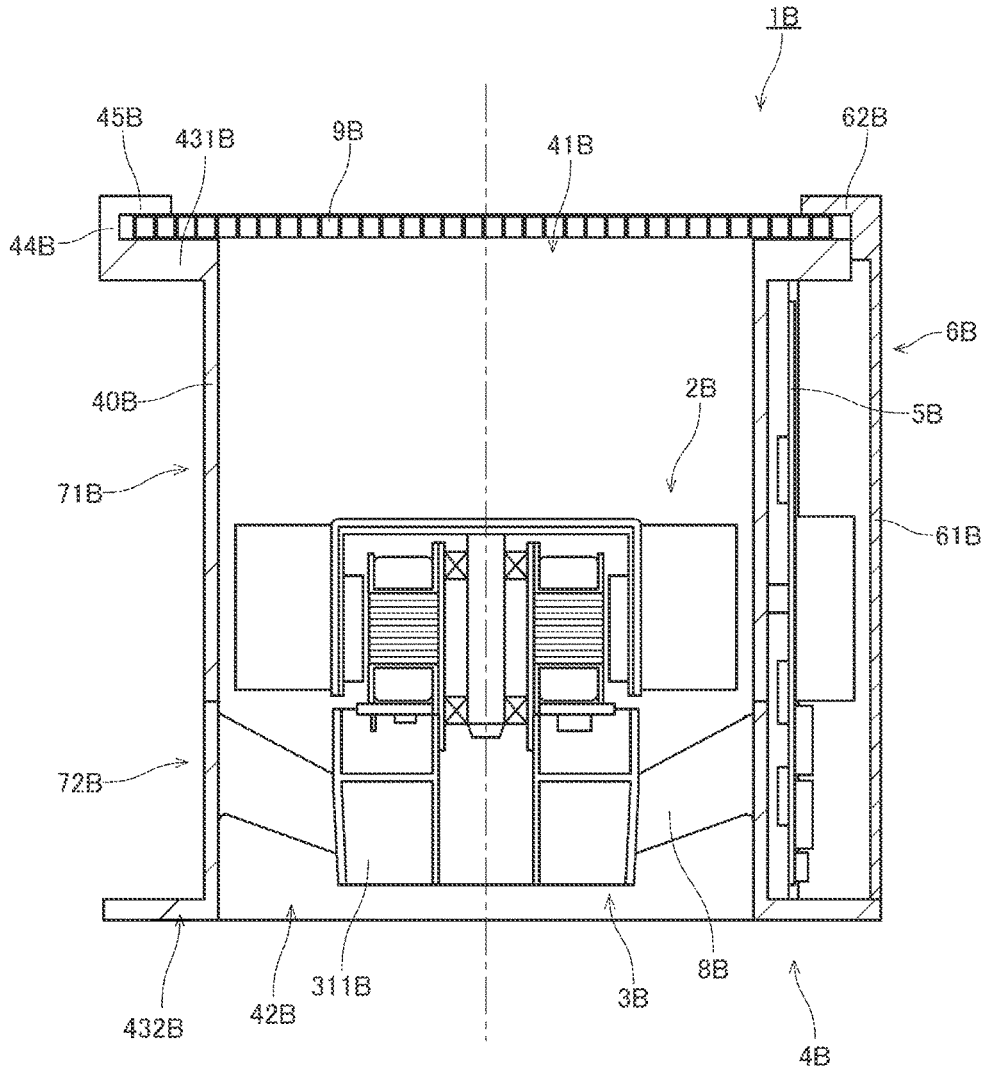
FIG. 9 is a vertical sectional view of a fan according to a further preferred embodiment at line B-B as seen in FIG. 3.
Figure 10:
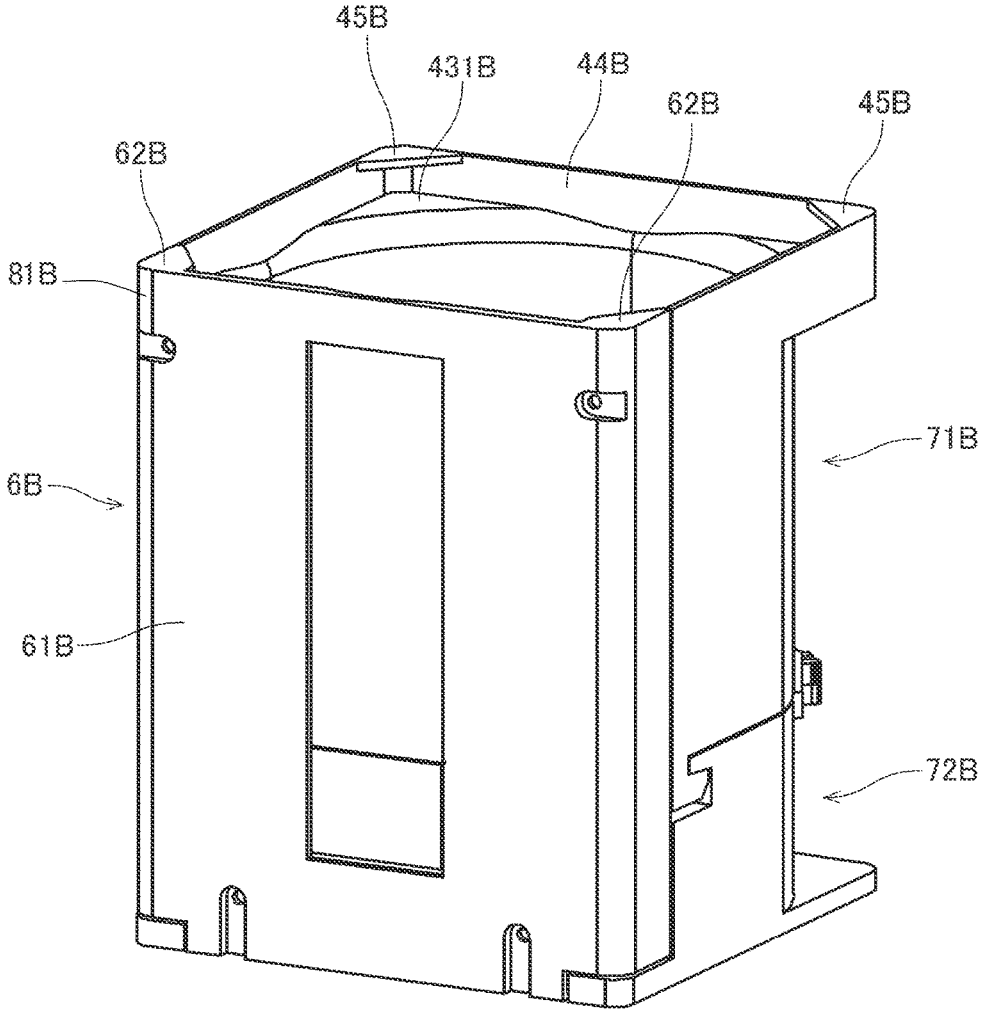
FIG. 10 is a perspective view of a fan according to the further preferred embodiment with a flow straightening grid is removed.

Subsequently, a fan 1B according to a further preferred embodiment will be described with reference to FIGS. 9 and 10. FIG. 9 is a vertical sectional view of the fan 1B. FIG. 10 is a perspective view of the fan 1B with a flow straightening grid 9B thereof removed. Even in the fan 1B, similar to the fan 1 according to one preferred embodiment, the axial upper side in FIGS. 9 and 10 is an intake side and the axial lower side is an exhaust side.

The fan 1B includes an impeller 2B, a motor part 3B, a housing 4B, a first circuit board 5B, a cover 6B, ribs 8B and a flow straightening grid 9B. The housing 4B includes a cylindrical body portion 40B which accommodates the impeller 2B and the motor part 3B, an upper flange portion 431B extending radially outward from the body portion 40B, and a wall portion 44B extending upward from the radial outer edge of the upper flange portion 431B. The flow straightening grid 9B is disposed radially inward of the wall portion 44B.

An intake port 41B, which is an upper opening of the housing 4B, is provided at the upper end of the body portion 40B. An exhaust port 42B, which is a lower opening of the housing 4B, is provided at the lower end of the body portion 40B. The flow straightening grid 9B is placed on the upper surface of the upper flange portion 431B. More specifically, the flow straightening grid 9B is placed on the upper surfaces of the corner portions 81B of the upper flange portion 431B.

Furthermore, the housing 4B includes a first housing 71B positioned at the axial upper side and a second housing 72B disposed at the axial lower side of the first housing 71B. For that reason, the upper part of the body portion 40B is configured by the first housing 71B, and the lower part of the body portion 40B is configured by the second housing 72B. Moreover, the second housing 72B, the ribs 8B and the base portion 311B of the motor are formed into one piece.

In the fan 1B, the wall portion 44B does not annularly extend. The radial outer edges of the upper flange portion 431B and the lower flange portion 432B have a substantially square shape. In the present preferred embodiment, the cover 6B includes an outer wall portion 61B which has an angulated U-like shape when viewed in the axial direction. The outer wall portion 61B covers the radial outer end surface of one of four sides of the radial outer edge of the upper flange portion 431B. Furthermore, the outer wall portion 61B covers the radial outer end surfaces of some portions of two sides connected to the one side of the upper flange portion 431B. The wall portion 44B does not exist in the region where the radial outer end surface of the upper flange portion 431B is covered by the outer wall portion 61B of the cover 6B. In this region, the outer wall portion 61B serves as the wall portion 44B. In this fan 1B, the flow straightening grid 9B is disposed radially inward of the wall portion 44B and radially inward of the outer wall portion 61B.

In the fan 1B, the housing 4B includes a grid holding portions 45B protruding radially inward from the wall portion 44B. Furthermore, the cover 6B includes protrusion portions 62B protruding radially inward from the outer wall portion 61B. The grid holding portions 45B and the protrusion portions 62B are disposed above the flow straightening grid 9B. Thus, some portions of the flow straightening grid 9B are axially interposed between the upper flange portion 431B and the grid holding portions 45B. Moreover, other portions of the flow straightening grid 9B are axially interposed between the upper flange portion 431B and the protrusion portions 62B. Thus, the flow straightening grid 9B is held in place.

As described above, the fan 1B may include the grid holding portions 45B and the protrusion portions 62B. This makes it possible to dispose the flow straightening grid 9B without causing the flow straightening grid 9B to protrude upward beyond the housing 4B and the cover 6B. It is therefore possible to hold the flow straightening grid 9B in a more stable manner.

During the manufacture of the fan 1B, other portions of the motor part 3B and the impeller 2B are assembled with the second housing 72B, the ribs 8B and the base portion 311B. Then, a balance is corrected by attaching a weight to the motor part 3B or the impeller 2B. After the balance correction, the first housing 71B is further assembled.

In through fan 1B, as illustrated in FIG. 9, the first housing 71B and the second housing 72B are fastened to each other at the upper side of the ribs 8B and at the lower side of the impeller 2B. Thus, when correcting a balance, the impeller 2B is exposed from the housing 4B. This makes it easy to attach a balance-correcting weight. Accordingly, the manufacturing work efficiency is improved.

While some exemplary preferred embodiments of the present invention have been described above, the present invention is not limited to the aforementioned preferred embodiments.

Figure 11:
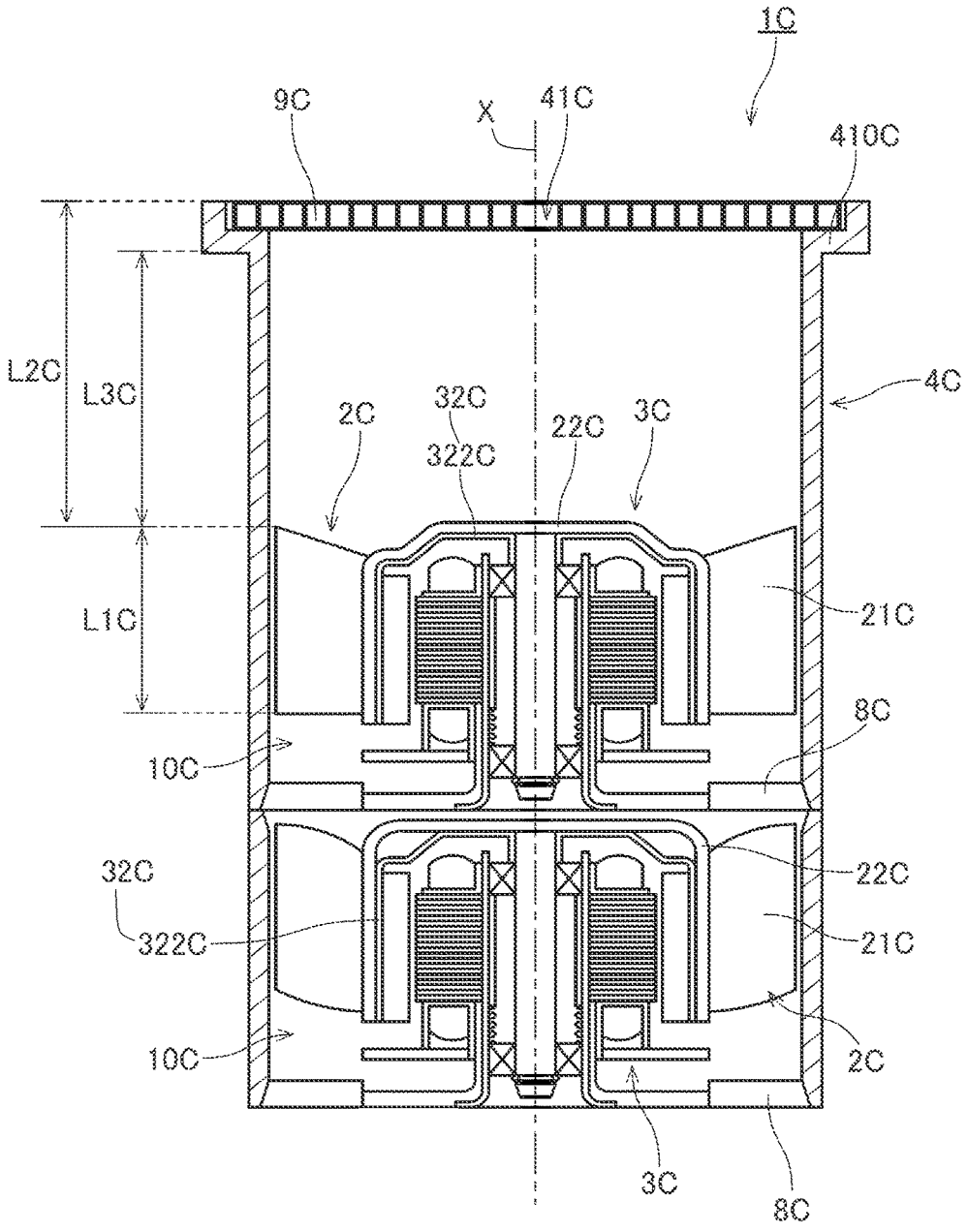
FIG. 11 is a vertical sectional view of a fan according to a modification.

FIG. 11 is a vertical sectional view of a fan 1C according to one modification. In this fan 1C, similar to the aforementioned preferred embodiments, the axial upper side in FIG. 11 is an intake side and the axial lower side is an exhaust side.

The fan 1C includes two impellers 2C, two motor parts 3C, a housing 4C and two sets of ribs 8C. One blower mechanism 10C is configured by one impeller 2C, one motor part 3C and one set of ribs 8C. At the radial inner side of the housing 4C, two blower mechanisms 10C are disposed one above another in the axial direction.

The impeller 2C is fixed to a rotary unit 32C of the motor part 3C. More specifically, an inner circumferential surface of a cup portion 22C of the impeller 2C is fixed to an outer circumferential surface of a rotor hub 322C of the rotary unit 32C. The impeller 2C includes a plurality of blades 21C which rotates together with the rotary unit 32C of the motor part 3C. The rotary unit 32C of the motor part 3C rotates the impeller 2C about a center axis X extending in the up-down direction. The ribs 8C interconnect the motor part 3C and the housing 4C.

In the fan 1C, the ribs 8C which interconnects the upper motor part 3C and the housing 4C are disposed below the upper impeller 2C and the upper motor part 3C. Furthermore, the ribs 8C which interconnects the lower motor part 3C and the housing 4C are disposed below the lower impeller 2C and the lower motor part 3C. Thus, in the fan 1C, the impeller 2C, the ribs 8C, the impeller 2C and the ribs 8C are disposed in the named order from the axial upper side toward the axial lower side.

However, the positions of the ribs 8C are not limited thereto. The ribs 8C may be disposed at the upper side of each of the impellers 2C. The ribs 8C, the impeller 2C, the ribs 8C and the impeller 2C may be disposed in the named order from the axial upper side toward the axial lower side. Alternatively, the positional relationship of the ribs 8C and the impellers 2C may differ at the upper side and the lower side. That is to say, the ribs 8C, the impeller 2C, the impeller 2C and the ribs 8C may be disposed in the named order from the axial upper side toward the axial lower side. The impeller 2C, the ribs 8C, the ribs 8C and the impeller 2C may be disposed in the named order from the axial upper side toward the axial lower side.

In the fan 1C, the upper impeller 2C and the lower impeller 2C differ in rotation direction from each other. That is to say, the fan 1C is a so-called counter-rotating fan. By employing the counter-rotating fan, it is possible to obtain a high wind pressure and a high static pressure without increasing the diameter of the fan. The present invention is not limited to the counter-rotating fan but may be applied to a fan which includes two impellers rotating in the same direction.

As illustrated in FIG. 11, in the fan 1C, the axial distance L2C from the upper end of each of the blades 21C of the upper impeller 2C to the upper end of the intake port 41C is ½ times or more of the axial distance L1C from the upper end of each of the blades 21C of the upper impeller 2C to the lower end thereof. Thus, the intake port 41C is disposed at the upper side of the region where the swirling component is mainly generated during the rotation of the upper impeller 2C. That is to say, an air flow having a swirling component is restrained from passing through the intake port 41C. This makes it possible to reduce a noise level. Thus, it is possible to reduce noises generated during the operation of the fan 1C, thereby making the fan 1C quiet.

In the fan 1C, the housing 4C includes a flow straightening grid 9C disposed in the upper edge 410C. The axial distance L3C from the upper end of each of the blades 21C of the upper impeller 2C to the upper edge 410C is set to become ½ times or more of the axial distance L1C from the upper end of each of the blades 21C of the upper impeller 2C to the lower end thereof. By doing so, an air flow having a swirling component is restrained from passing through the flow straightening grid 9C. Thus, the air flow is restrained from colliding with the flow straightening grid 9C. It is therefore possible to further reduce noises. As described above, the present invention may be applied to a double fan.

In the preferred embodiments described above, the axial position of the impeller overlaps with the axial position of the motor. However, the present invention is not limited thereto. The impeller may be disposed above the motor.

Furthermore, in the preferred embodiments described above, the body portion of the housing is configured by two members, namely the first housing and the second housing. However, the present invention is not limited thereto. The body portion of the housing may be configured by a single member.

Furthermore, in the preferred embodiments described above, the shape of the radial outer edge of the flange portion is a substantially square shape. However, the present invention is not limited thereto. As long as the grid mounting portions can be provided, the shape of the upper flange portion may be an annular shape or other shapes. In addition, the shape of the lower flange portion may be a shape other than the substantially square shape. The lower flange portion may not be provided.

Furthermore, in the preferred embodiments described above, the shape of the radial outer edge of the wall portion is a substantially square shape. However, the present invention is not limited thereto. As long as the flow straightening grid can be disposed radially inward of the wall portion, the shape of the wall portion may be an annular shape or other shapes.

The respective elements appearing in the preferred embodiments and the modifications described above may be appropriately combined as long as no conflict arises.

Features of the above-described preferred embodiments and the modifications thereof may be combined appropriately as long as no conflict arises.

The present invention may be utilized in, e.g., an axial flow fan.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fan comprising:

a motor that rotates about a center axis extending up and down;

an impeller including a plurality of blades extending radially outward, the impeller being fixed to the motor;

a housing that surrounds outer peripheries of the motor and the impeller, the housing including a cylindrical inner circumferential surface; and a plurality of ribs that interconnect the motor and the housing, wherein the housing includes an intake port which is an upper opening of the housing, an upper edge which surrounds the intake port, an exhaust port which is a lower opening of the housing, a lower edge which surrounds the exhaust port, and a flow straightening grid disposed in the upper edge, an axial distance from an upper end of each of the blades to a lower end of the flow straightening grid is ½ times or more of an axial distance from the upper end of each of the blades to a lower end thereof, the housing further includes a flange portion extending radially outward from an upper edge of the housing to define a projection extending radially outward from remaining portions of the housing, the flange portion includes four grid mounting portions provided on an upper surface of four corners of the flange portion, the flow straightening grid is located on the four grid mounting portions, and a holding member is disposed above the flow straightening grid in a perpendicular or substantially perpendicular relationship with the center axis, the holding member including a central hole which axially overlaps with the intake port, and corners of the flow straightening grid are held between the four grid mounting portions and the holding member.

2. The fan of claim 1, wherein the flow straightening grid includes a plurality of axially-extending through-holes.

3. The fan of claim 2, wherein a projection area of the flow straightening grid on a plane perpendicular to an axial direction is 10% or less of a projection area of the intake port on a plane perpendicular to the axial direction.

4. The fan of claim 1, wherein a grid thickness of the flow straightening grid in a direction perpendicular to an axial direction is 0.03 mm or more and 0.1 mm or less.

5. The fan of claim 1, wherein a height of the flow straightening grid in a direction parallel to an axial direction is 2.0 mm or more and 10 mm or less.

6. The fan of claim 1, wherein the flange portion further includes a wall portion extending upward from a radial outer edge of the flange portion, and the flow straightening grid is disposed radially inward of the wall portion.

7. The fan of claim 6, wherein an axial position of an upper end of the wall portion is flush with or higher than an axial position of an upper end of the flow straightening grid.

8. The fan of claim 1, wherein a shape of a radial outer edge of the flange portion is a substantially square shape.

9. The fan of claim 1, wherein the housing further includes a grid holding portion protruding radially inward from an upper side of the flange portion, and the flow straightening grid is held between the grid mounting portion and the grid holding portion.

10. The fan of claim 1, wherein the flange portion has a mounting hole disposed radially outward of the grid mounting portion and formed to axially penetrate the flange portion.

11. The fan of claim 1, further comprising:

a circuit board electrically connected to the motor and mounted with a plurality of electronic components; and a cover member including an outer wall portion disposed radially outward of the housing, wherein the housing further includes a lower flange portion extending radially outward from the lower edge, the circuit board axially extends at a radial outer side of the housing and at a radial inner side of a radial outer edge of the lower flange portion, and the circuit board is disposed between an outer circumferential surface of the housing and the outer wall portion.

12. The fan of claim 1, further comprising:

a cover member including an outer wall portion disposed radially outward of the housing and a protrusion portion protruding radially inward from the outer wall portion, wherein the flow straightening grid is held between the flange portion and the protrusion portion.

13. The fan of claim 1, wherein the ribs are disposed below the impeller.

14. The fan of claim 13, wherein the housing includes a first housing positioned at an axial upper side and a second housing positioned at an axial lower side, and the first housing and the second housing are fastened to each other at an upper side of the ribs and at a lower side of the impeller.

15. The fan of claim 1, wherein an axial distance from the upper end of each of the blades to the upper edge is equal to or longer than an axial distance from the upper end of each of the blades to the lower end thereof.

16. The fan of claim 1, wherein an axial distance from the upper end of each of the blades to the upper edge is three times or less of an axial distance from the upper end of each of the blades to the lower end thereof.

* * * * *